US012576999B2

(12) United States Patent
Merz

(10) Patent No.: US 12,576,999 B2
(45) Date of Patent: Mar. 17, 2026

(54) SACHET AND PACKAGING MACHINE

(71) Applicant: MERZ VERPACKUNGSMASCHINEN GMBH, Lich (DE)

(72) Inventor: Holger Merz, Lich (DE)

(73) Assignee: MERZ VERPACKUNGSMASCHINEN GMBH, Lich (DE)

( * ) Notice: Subject to any disclaimer, the term of this patent is extended or adjusted under 35 U.S.C. 154(b) by 271 days.

(21) Appl. No.: 17/488,737

(22) Filed: Sep. 29, 2021

(65) Prior Publication Data

US 2022/0097875 A1 Mar. 31, 2022

(30) Foreign Application Priority Data

Sep. 29, 2020 (DE) ..... 20 2020 105 554.2

(51) Int. Cl.

| | |
|---|---|
| ***B65B 1/02*** | (2006.01) |
| ***B65B 43/04*** | (2006.01) |
| ***B65D 33/00*** | (2006.01) |
| ***B65D 81/26*** | (2006.01) |

(52) U.S. Cl.

CPC ..... *B65B 1/02* (2013.01); *B65B 43/04* (2013.01); *B65D 33/00* (2013.01); *B65D 81/264* (2013.01)

(58) Field of Classification Search

CPC ..... B65B 1/02; B65B 43/04; B65B 15/00; B65B 55/19; B65B 9/20; B65D 33/00; B65D 81/264; B65D 33/01; B65D 75/44

See application file for complete search history.

(56) References Cited

U.S. PATENT DOCUMENTS

| | | | | | |
|---|---|---|---|---|---|
| 3,084,984 | A * | 4/1963 | Adler | B65B 25/001 | 426/127 |
| 3,419,400 | A * | 12/1968 | Hayhurst | B65D 81/18 | 426/316 |
| 3,670,874 | A * | 6/1972 | Brunner | B65D 81/268 | 426/240 |
| 4,617,683 | A * | 10/1986 | Christoff | B29C 66/4322 | 53/139.2 |
| 4,726,171 | A * | 2/1988 | Kreager | B65B 9/067 | 53/410 |
| 4,861,632 | A * | 8/1989 | Caggiano | B32B 27/304 | 426/127 |

(Continued)

FOREIGN PATENT DOCUMENTS

| | | | | |
|---|---|---|---|---|
| DE | 202018105734 U1 * | 11/2018 | | B65D 33/16 |
| EP | 0257892 A2 * | 3/1988 | | B65D 81/268 |
| JP | H07110649 A | 4/1995 | | |

*Primary Examiner* — Anna K Kinsaul
*Assistant Examiner* — Mobeen Ahmed
(74) *Attorney, Agent, or Firm* — Dickinson Wright PLLC; Andrew D. Dorisio; Nicholas P. Coleman

(57) ABSTRACT

The invention relates to a sachet (10) and a packaging machine and a method for producing a sachet, the sachet forming a closed chamber (18) in which a product is accommodated, the sachet being made of only one film web (12) which is formed into a tube (11), a weld seam (13) being formed in a longitudinal direction along the sachet, a closure seam (16, 17) being formed at each end (15) of the sachet, wherein a strip (20) having a desiccant is disposed within the chamber, the strip being welded to the film web.

10 Claims, 1 Drawing Sheet

(56) References Cited

U.S. PATENT DOCUMENTS 4,907,393 A * 3/1990 Omori ..... B65D 81/268 53/238
5,620,095 A * 4/1997 Delmore ..... B65D 75/58 383/201
5,833,058 A * 11/1998 Mabry ..... B65D 81/264 206/204
6,041,575 A * 3/2000 Vonderhorst ..... B65B 51/303 53/157
6,089,367 A * 7/2000 Anderson ..... B65D 81/264 206/204
6,139,935 A * 10/2000 Cullen ..... B32B 5/16 428/68
7,600,360 B2 * 10/2009 Schroeder ..... B65B 61/186 53/562
8,985,322 B2 * 3/2015 Cullison ..... B65B 55/20 206/204
11,021,312 B2 * 6/2021 Fath ..... B65B 25/067
2006/0037884 A1 * 2/2006 Doyle ..... B65D 33/01 383/102
2008/0178559 A1 * 7/2008 DeFedericis ..... B65B 61/20 53/469
2009/0314676 A1 * 12/2009 Peck ..... A61L 2/206 206/438
2014/0219586 A1 * 8/2014 DeFedericis ..... B29C 66/81433 156/580.2
2015/0274334 A1 * 10/2015 Lökös ..... B65B 35/44 53/451
2018/0057241 A1 * 3/2018 Love ..... B65D 81/266
2020/0016034 A1 * 1/2020 Voellmicke ..... A61J 1/035
2020/0039723 A1 * 2/2020 Knutsen ..... B65D 81/18
2020/0361684 A1 * 11/2020 Clarke ..... B65B 51/10
2021/0253286 A1 * 8/2021 Ogino ..... B65B 31/048
2021/0321920 A1 * 10/2021 Ahl ..... B65B 61/00
2022/0402679 A1 * 12/2022 Watson ..... B65D 81/264
2023/0034298 A1 * 2/2023 Wang ..... B65D 81/2038

* cited by examiner

SACHET AND PACKAGING MACHINE

TECHNICAL FIELD

The invention relates to a sachet and a packaging machine and a method for forming sachets, the sachet forming a closed chamber in which a product is accommodated, the sachet being made of only one film web which is formed into a tube, a weld seam being formed in a longitudinal direction along the sachet, a closure seam being formed at each end of the sachet.

BACKGROUND

Such sachets are sufficiently known from the state of the art and are, among other things, also called tubular bags, small tubular bags or stickpacks. Small tubular bags or stickpacks serve to package small products and/or product quantities. Said products can, for example, be liquids, powders, granules or small piece goods, such as reagents, medicinal powders, tablets etc. In order to produce the sachet and in order to package the product in the sachet, a film web made of a plastic material or a polymer is drawn off from a reel and guided over a forming shoulder. The forming shoulder is realized in such a manner that the film web is folded at the forming shoulder in such a manner that opposite long sides of the film web are brought together and a tube is formed. The long sides are then welded together such that a single weld seam is formed in a longitudinal direction along the sachet. At a lower end of the sachet, a closure seam is formed by welding the film web shut such that the product can be fed into a chamber, which is formed from the film web in such a manner and which is open toward the top, via a tube. The chamber is, in turn, welded shut with a closure seam at an upper end, wherein this closure seam can, at the same time, realize a closure seam at a lower end of a subsequent chamber.

Furthermore, such products can also be packaged in so-called flat bags, the products being disposed between two film webs which are independent of each other and the two film webs being welded together to form a sachet by forming corresponding weld seams. In these sachets, weld seams run circumferentially along lateral edges of the sachets. In this case it is disadvantageous that a comparatively larger quantity of film is required for forming such sachets, depending on a package content. Alternatively, such products can also be packaged in so-called cup blisters or blister cards. In this case, however, it is disadvantageous that a tool has to be manufactured for a blister package and that, thus, a size of the chamber is fixed. In contrast, in the case of a sachet, a size of a chamber can be variably selected by applying the weld seams.

SUMMARY

Furthermore, it is known to add desiccants to packages. Said desiccants are typically silica gel or zeolites in the form of granules. Such desiccants can hardly be used in comparatively small sachets, in particular since a contamination of the product has to be precluded.

The object of the invention is therefore to propose a sachet and a packaging machine by means of which it is possible to keep products safely and easily dry.

This object is attained by a sachet having the features of claim 1, a packaging machine and a method of making the sachet.

The sachet according to the invention forms a closed chamber, a product being accommodated in the chamber, the sachet being made of only one film web which is formed into a tube, a weld seam being formed in a longitudinal direction along the sachet, a closure seam being formed at each end of the sachet, wherein a strip having a desiccant is disposed within the chamber, the strip being welded to the film web.

According to the invention, the sachet is made of one single film web of a plastic material. Therefore, also only one weld seam is formed in the longitudinal direction along the sachet. The strip having the desiccant is disposed within the chamber at the same time, the strip also consisting of a plastic material. Since it is a strip, that is, a relatively long one-piece element compared to a width, a mixing of the strip with a product can be largely precluded. There is also no danger of the strip being confused with the product since the strip is welded to the film web and, thus, cannot be easily taken out of the chamber. The welding of strips and film webs is made possible since the strip and the film web are made of a corresponding plastic material. The welding can be carried out with simple means at low cost.

One side of the strip can be completely welded to the film web. In this case, the product, in particular a powdery product, cannot get between the film web and the strip. Welding the entire surface of the strip to the film web ensures that the sachet can also be completely emptied.

A length of the strip can be smaller than a relative distance of the closure seams, the strip being disposed between the closure seams. In this case, the strip cannot prevent a tight welding of the closure seams and possibly cause the sachet to be untight. At the same time, the length of the strip can also be dimensioned in such a manner that a quantity of desiccant which is just necessary is disposed in the chamber.

The strip can be disposed adjacent to the weld seam and parallel with respect to it. Thus, the strip can be disposed next to the weld seam. In principle, it would also be possible to dispose the strip at any point of the chamber. The parallel orientation of the strip with respect to the weld seam can be obtained by moving the strip together with the film web in a feed direction. The strip can be conveyed from a reel, just as the film web, applied onto the film web and cut to a desired length.

The sachet can be realized having a length in a range from 30 to 190 mm and having a width in a range from 17 to 50 mm, the strip being able to be realized having a width in a range from 3 to 10 mm. In this case, a width of the strip can be advantageously adapted to a width of the chamber.

The weld seam can form a lateral edge of the sachet. The sachet can form an essentially rectangular or elliptical contour in a cross section. With respect to the cross section, the weld seam can be applied in such a manner that it forms an outer lateral edge of the sachet.

According to another embodiment, the weld seam can be formed along a central area of a long side of the sachet. With respect to a cross section of the sachet, the weld seam can, in this case, essentially be formed in a center of one of the long sides of the sachet. If the weld seam is disposed in this way, the sachet can be filled with a comparatively large volume.

Alternatively, the weld seam can be formed along a long side and adjacent to a narrow side of the sachet. In this case, the narrow side can form a lateral edge of the sachet with regard to a cross section of the sachet.

Furthermore, the weld seam may be folded at the long side. The folded weld seam can be welded shut at the closure seams in such a manner that it overlaps with them. Thus, the weld seam can be fixed in this folded position.

The product can be a powder, granules or at least one tablet. In particular, the product can be a pharmaceutical product.

The packaging machine according to the invention serves to form sachets according to the invention.

The packaging machine can comprise a reel dispenser for dispensing a web-shaped film, a forming shoulder for folding the film into a sachet, a longitudinal welding device for forming the weld seam at the sachet, a tube for feeding a product into the lengthwise welded sachet while the film web is being moved or after the film web has been moved past the longitudinal welding device, and a transverse welding device for forming the closure seam at the respective ends of the sachet.

Furthermore, the packaging machine can comprise a strip applicator for dispensing a web-shaped strip and a strip welding device for welding the strip to the film web before the film web passes or after the film web has passed the forming shoulder. In principle, it is irrelevant at which moment the strip is welded to the film web, as long as the chamber has not been completely closed yet in the longitudinal direction by the longitudinal welding device. Therefore, it is possible to apply the strip onto the film web before the film web passes the forming shoulder or afterward. The fixation of the strip to the film web before passing the form shoulder can advantageously be carried out by means of the strip welding device. In this case, the strip can already be cut to a desired length before or while being applied to the film web.

Further advantageous embodiments of the packaging machine are apparent from the feature descriptions of the dependent claims referring back to claim 1.

Furthermore, a method for producing a sachet can be carried out by means of the packaging machine.

In the method according to the invention for forming sachets by means of a packaging machine, a closed chamber of the sachet is formed in which a product is accommodated, the sachet being made of only one film web which is formed into a tube, a weld seam being formed in a longitudinal direction along the sachet, a closure seam being formed at each end of the sachet, wherein a strip having a desiccant is disposed within the chamber, the strip being welded to the film web.

Further advantageous embodiments of the method are apparent from the feature descriptions of the dependent claims referring back to claim 1.

BRIEF DESCRIPTION OF THE DRAWINGS

Below, the invention is explained in more detail with reference to the accompanying drawings.

In the figures.

DETAILED DESCRIPTION

Figure 1:
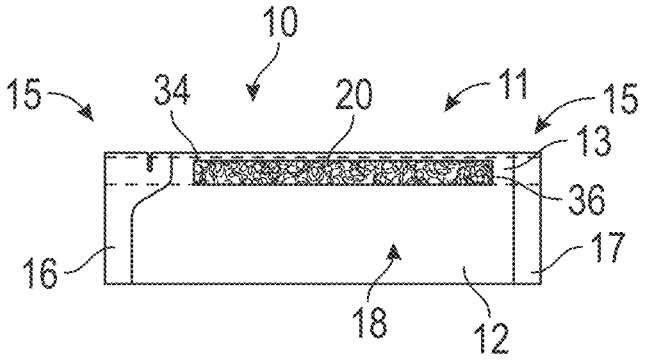
FIG. 1 shows a side view of a first embodiment of a sachet.
Figure 2:
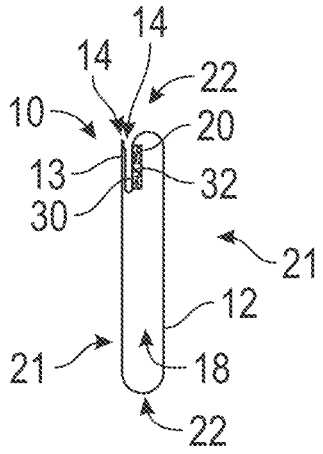
FIG. 2 shows a sectional view of the sachet from FIG. 1.

A combination of FIGS. 1 and 2 shows a sachet 10 without a product accommodated therein being shown in more detail. Sachet 10 is made only of one film web 12 which is formed into a tube 11. A weld seam 13 is formed in a longitudinal direction along sachet 10 and connects in this way film web 12 at its lateral edges 14. Closure seams 16 and 17 are formed at respective ends 15 of sachet 10 by welding film web 12 shut. Sachet 10 is thus realized having a tightly closed chamber 18 for accommodating a product.

A strip 20 made of a plastic material and having a desiccant is disposed within chamber 18. The strip 20 may include two opposing planar sides 30, 32. Strip 20 is completely welded to film web 12. That is, an entire surface of one of the two opposing planar sides of the strip 20 from a first end 34 of the strip to a second end 36 of the strip may be welded to the film web. In particular, a length of strip 20 is smaller than a relative distance of closure seams 16 and 17 such that strip 20 is disposed between closure seams 16 and 17. Furthermore, strip 20 is disposed adjacent to weld seam 13 and parallel with respect to it. Before folding film web 12 at a forming shoulder of a packaging machine (not shown), strip 20 can be applied and fixed adjacent to a lateral edge 14 of film web 12 by means of a strip welding device of the packaging machine. In the embodiment of sachet 10 which is shown in the case at hand, weld seam 13 is formed along a long side 21 and adjacent to a narrow side 22 of sachet 10 and folded at long side 21.

Figure 3:
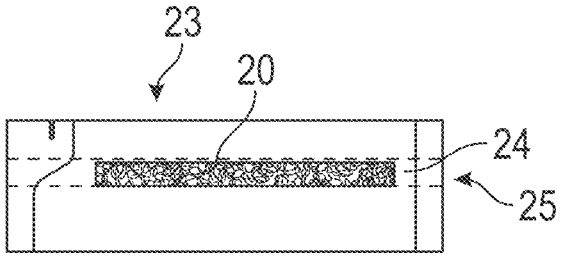
FIG. 3 shows a side view of a second embodiment of a sachet.
Figure 4:
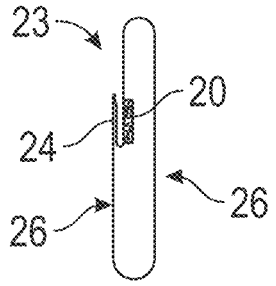
FIG. 4 shows a sectional view of the sachet from FIG. 3.

A combination of FIGS. 3 and 4 shows a sachet 23 in which, in contrast to the sachet from FIG. 1, a weld seam 24 is formed along a central area 25 of a long side 26 of sachet 23. Weld seam 24 is also folded at long side 26. Strip 20 is accordingly disposed in central area 25.

Figure 5:
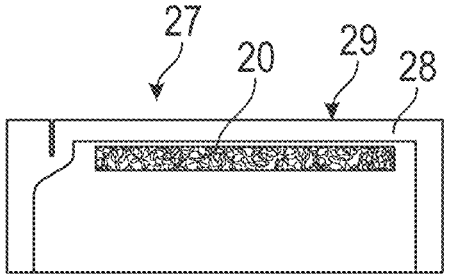
FIG. 5 shows a side view of a third embodiment of a sachet.
Figure 6:
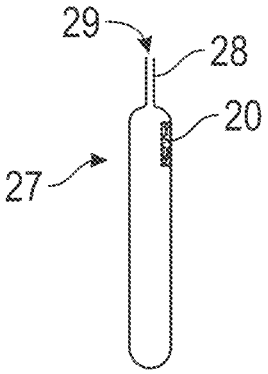
FIG. 6 shows a sectional view of the sachet from FIG. 5.

A combination of FIGS. 5 and 6 shows a sachet 27 which, in contrast to the sachet from FIG. 1, has a weld seam 28 forming a lateral edge 29 of sachet 27. Weld seam 28 is not folded, strip 20 being disposed adjacent to weld seam 28.

The invention claimed is:

1. A sachet (10, 23, 27), the sachet forming a closed chamber (18) in which a product is accommodated, the sachet being made of only one film web (12) which is formed into a tube (11), a weld seam (13, 24, 28) being formed in a longitudinal direction along the sachet, a closure seam (16, 17) being formed at each end (15) of the sachet, wherein a strip (20) having a desiccant is disposed within the chamber, wherein the entire surface of one side of the strip (20) from a first end of the strip to a second end of the strip is welded to the film web (12).

2. The sachet according to claim 1, wherein a length of the strip (20) is smaller than a relative distance of the closure seams (16, 17), the strip being disposed between the closure seams.

3. The sachet according to claim 1, wherein the strip (20) is disposed adjacent to the weld seam (13, 24, 28) and parallel with respect to it.

4. The sachet according to claim 1, wherein the sachet (10, 23, 27) is realized having a length in a range from 30 to 190 mm and having a width in a range from 17 to 50 mm, the strip (20) being realized having a width in a range from 3 to 10 mm.

5. The sachet according to claim 1, wherein the weld seam (28) forms a lateral edge (29) of the sachet (27).

6. The sachet according to claim 1, wherein the weld seam (24) is formed along a central area (25) of a long side (26) of the sachet (23).

7. The sachet according to claim 6, characterized in that the weld seam (13, 24) is folded at the long side (21, 26).

8. The sachet according to claim 1, wherein the weld seam (13) is formed along a long side (21) and adjacent to a narrow side (22) of the sachet (10).

9. The sachet according to claim 1, wherein the product is a powder, granules or at least one tablet.

10. A method for forming sachets (10, 23, 27) by means of a packaging machine, comprising forming a closed chamber (18) of the sachet in which a product is accommodated, the sachet being made of only one film web (12) which is formed into a tube (11), a weld seam (13, 24, 28) being formed in a longitudinal direction along the sachet, a closure seam (16, 17) being formed at each end (15) of the sachet, wherein a strip (20) having a desiccant is disposed within the chamber, the method comprising welding the entire surface of one side of the strip (20) from a first end of the strip to a second end of the strip, to the film web (12).

* * * * *